United States Patent [19]

DeGraaf et al.

[11] 4,193,368

[45] Mar. 18, 1980

[54] OFFSHORE MOORING SYSTEM FOR VESSEL OR SHIP

[75] Inventors: Douglas W. DeGraaf, Addison; William A. Tam, Warrenville, both of Ill.

[73] Assignee: Chicago Bridge & Iron Company, Oak Brook, Ill.

[21] Appl. No.: 870,993

[22] Filed: Jan. 20, 1978

[51] Int. Cl.[2] ..... B63B 21/52

[52] U.S. Cl. ..... 114/230; 9/8 P

[58] Field of Search ..... 114/230; 9/8 P; 141/387

[56] References Cited

U.S. PATENT DOCUMENTS

| | | | |
|---|---|---|---|
| 3,908,212 | 9/1975 | van Heijst | 9/8 P |
| 4,010,500 | 3/1977 | Reid | 9/8 P |
| 4,052,090 | 10/1977 | Stafford | 9/8 P |

*Primary Examiner*—Barry L. Kelmachter
*Assistant Examiner*—Jesus D. Sotelo
*Attorney, Agent, or Firm*—Merriam, Marshall & Bicknell

[57] ABSTRACT

A quick-release mooring apparatus for a floating vessel comprising a substantially stationary structure anchored to the sea floor and projecting above sea level, a vessel mooring member attached at a first end above sea level to the stationary structure in a manner which permits the mooring member to rotate about vertical and horizontal axes passing through the point of attachment to the stationary structure, the second end of the mooring member comprising a vessel mooring yoke having a pair of spaced arms, one end of each of which is adapted to be releasably attached, by lifting the vessel mooring yoke, to opposite sides of the bow of a vessel for rotation about a horizontal axis, and the mooring member having sufficient buoyancy for the second end to float on the sea when unconnected to a vessel. The stationary structure can be a buoy anchored to the sea floor by lines, or it can be a tower supported by the sea floor.

20 Claims, 9 Drawing Figures

OFFSHORE MOORING SYSTEM FOR VESSEL OR SHIP

This invention relates to an offshore mooring system for a floating vessel or ship. More particularly, the invention relates to a quick-release apparatus for mooring a vessel to a substantially stationary means anchored offshore to the sea floor and projecting above sea level so that the vessel can rotate about a vertical axis.

It is sometimes desired to moor a floating ship or other vessel in an offshore location for loading or unloading cargo or for extended or indefinite periods of time. A typical instance of such use arises in conjunction with the operation of an offshore oil well, in which oil from below the surface of the ocean floor rises through pipes connected to a substantially stationary means and to a ship moored thereto. The oil can then be transported to shore. Also, instead of transporting the oil from the offshore location directly to a refinery, it has been proposed to moor to the buoyant tower a vessel which can be used to partially or completely process the crude oil. In such cases, the vessel is intended to remain moored in place for long periods of time. Regardless of how long the vessel is to be moored, to prevent damage to the vessel or to the substantially stationary means, it is desirable to provide a rigid mooring arm connecting the vessel to the stationary means. The rigid arm must be adequately strong to resist the forces exerted on it by the action of the wind, waves, and current and it must at the same time permit the vessel to rotate about the mooring point, as well as to roll and pitch. Further, it is desirable that the mooring arm be conveniently accessible, readily connectable to a vessel, and quickly disconnectable from the vessel without damage to either the vessel or any part of the mooring system. In view of the large size of the vessel, the elements of the mooring system must be large and heavy to withstand the enormous forces which are encountered. The size and weight of the mooring system combined with the size of the vessel, the movement of which must be controlled during the connect and disconnect procedures, create severe problems in the design of a mooring system for insuring that connection and disconnection can be readily made without damage to either the vessel or any element of the mooring apparatus.

U.S. Pat. Nos. 4,031,582; 4,010,500 and 3,908,212 illustrate offshore mooring apparatus employing yokes, but none show quick-disconnect mechanisms.

According to one aspect of the subject invention, there is provided a vessel mooring member for mooring a floating vessel to a substantially stationary means anchored to a sea floor and projecting above sea level. The vessel mooring member has means for attaching a first end thereof above sea level to the stationary means in a manner which permits the mooring member to rotate about vertical and horizontal axes passing through the point of attachment to the stationary means, the second end of the mooring member has a vessel mooring yoke with a pair of spaced arms, one end of each of which is adapted to be releasably attached, by lifting the vessel mooring yoke to opposite sides of the bow of a vessel for rotation about a horizontal axis, and the mooring member has sufficient buoyancy for the second end to float on the sea when it is unconnected to a vessel and when the first end is attached to a said stationary means.

In addition to the vessel mooring member, the invention includes the apparatus combination of the vessel mooring member attached to the stationary means, and the apparatus combination of the vessel mooring member attached by the first end to the stationary means and by the second end to a vessel.

The stationary means can be a buoy anchored to the sea floor by lines, or a rigid tower supported by the sea floor, or an articulated tower supported by the sea floor and having a universal joint below water level. An articulated tower can be provided with inherent buoyancy so that it will remain upright in the sea with reasonable swaying due to wind, waves and sea current.

The vessel mooring member is desirably permanently attached by the first end to the stationary means in a way which permits it to rotate 360° around the stationary means. Furthermore, the vessel mooring member is advisably joined to the stationary means so that it can rotate about a horizontal axis through an angle of about up to 45°, which usually is the maximum angle through which the vessel mooring member need be rotated upwardly from its floating position to releasable attachment to a vessel.

If desired, the vessel mooring member can be provided with an axial swivel connection so that the first and second ends of the member can rotate independently of each other. In this way, rolling of a moored ship can be accommodated when the stationary means is a rigid tower.

Each arm can be attached to a trunnion mounted on the vessel bow by a male-female connection which prevents independent horizontal movement of the vessel and arms after the connection has been made. Thus, each arm can contain a pocket or female element open at the top in which a vessel mounted trunnion, which can function as the male element, will mate when the vessel mooring yoke is lifted into releasable engageable contact therewith. Alternatively, the pocket can be located in the trunnion and the arm can contain the male element. Either way, the trunnion is desirably rotatable about a horizontal axis. The pocket and trunnion also should contain complementary surfaces to facilitate mating.

The vessel yoke arms are supportable, with the male-female elements of the trunnions and arms mated together, by a locking means removably positioned to restrain downward displacement of the arms from the trunnions and unmooring of the vessel, and which locking means upon being removed frees the arms and permits the vessel mooring yoke end to drop by gravity to the sea surface or be controllably lowered from the vessel.

The locking means releasably secures each trunnion to an arm of the vessel mooring yoke after mating of each pocket with a trunnion. One locking means can have at least one finger or pin adapted to extend from each trunnion to the adjacent vessel mooring yoke arm. Another locking means can include a pair of upper and lower parallel fingers joined together at one end and movable horizontally to position the upper finger above and in contact with the trunnion with the ends of the fingers removably nested in holes in the vessel yoke arm.

The invention will be described further in conjunction with the attached drawings, in which.

So far as is practical, the same or similar parts or elements which appear in the different views of the drawings will be identified by the same numbers.

Figure 1:
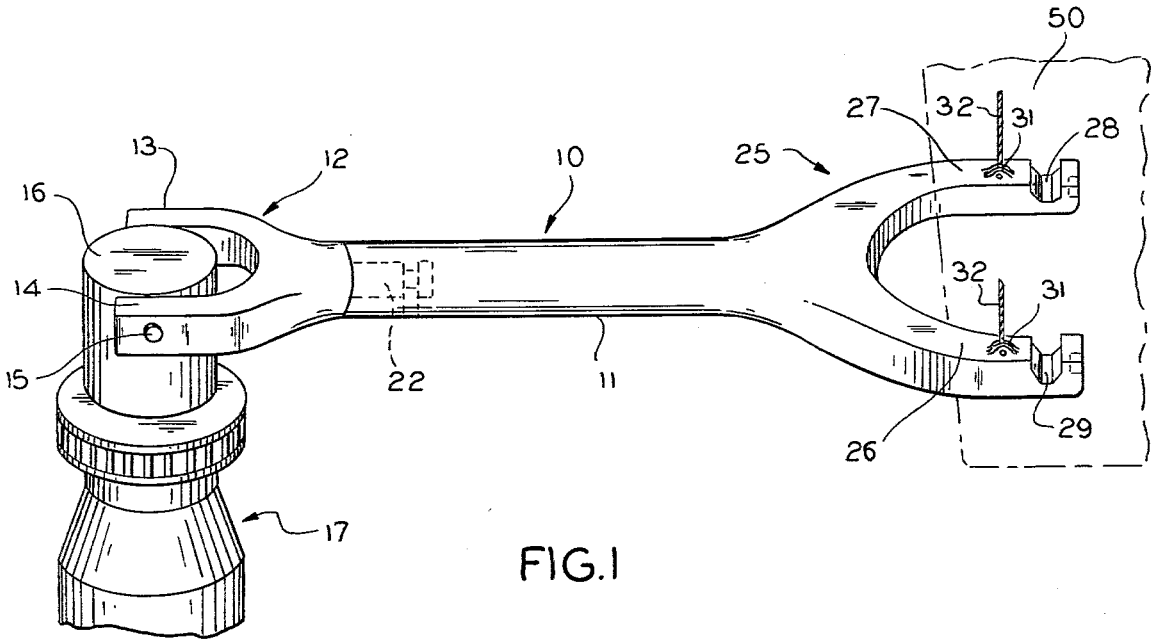
FIG. 1 is an isometric view of a vessel mooring member joined at one end to a tower and at the other end to a vessel.
Figure 2:
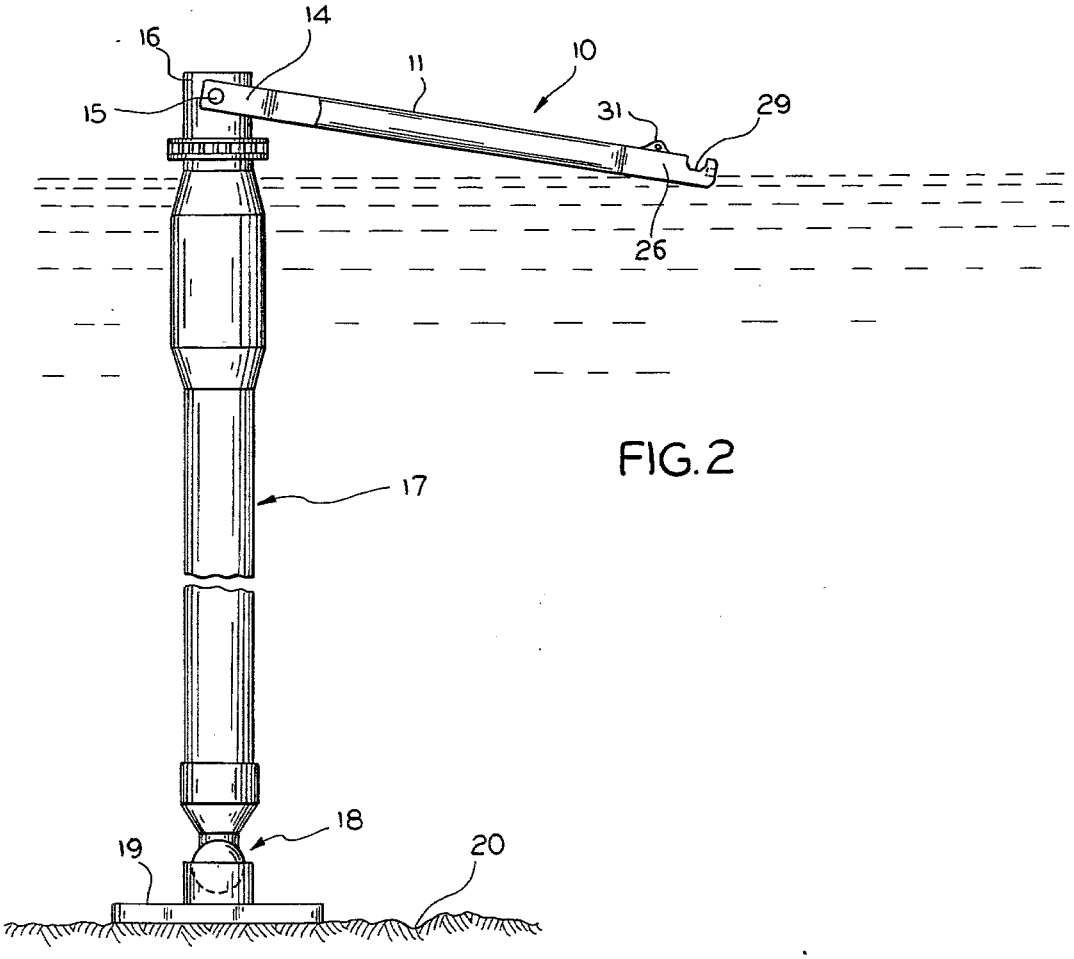
FIG. 2 is an elevational view of the vessel mooring member of FIG. 1 released from the vessel and floating on the sea.

With reference to FIGS. 1 and 2, the vessel mooring member 10 has a central body portion 11 with a first end in the form of a yoke 12 having arms 13 and 14. The arms 13 and 14 are pivotally joined by two horizontal pins 15 to swivel 16, mounted on the top of tower 17, so that it can rotate about horizontal and vertical axes.

Tower 17 is joined at the bottom by a ball and socket assembly 18 to base 19 which rests on sea floor 20. Tower 17 is provided with buoyancy chambers in its upper part to maintain it upright without guy lines. Of course, the ball and socket 18 can be replaced by a universal joint of the Cardan type.

The vessel mooring member 10 can be provided with an axial swivel 22, shown in phantom in FIG. 1, to accommodate rolling of the vessel if this is considered advisable, such as with a rigid tower fixed to the sea floor.

The second end of vessel mooring member 10 has a vessel mooring yoke 25 with two spaced apart arms 26 and 27 of equal size and length. The arms are spaced apart sufficiently far so as to receive the bow or prow of a vessel for mooring engagement. The yoke 25 is made largely hollow so that when not in use it will float on the sea surface as shown in FIG. 2, and to facilitate locating it when a vessel is to be moored. The vessel can then navigate directly into position with the vessel bow in the yoke ready for connection to the yoke.

The top of each arm 26 and 27 contains a pocket 28 and 29 open at the top for releasable engagement with two mating trunnions 30, one on each side of the ship bow. A lifting handle 31 is secured to the top of each arm. Two lines 32, operatively joined to a vessel 50 being moored, are used to raise the vessel mooring member 10 during mooring of the vessel by releasably attaching them to the handles 31.

Figure 3:
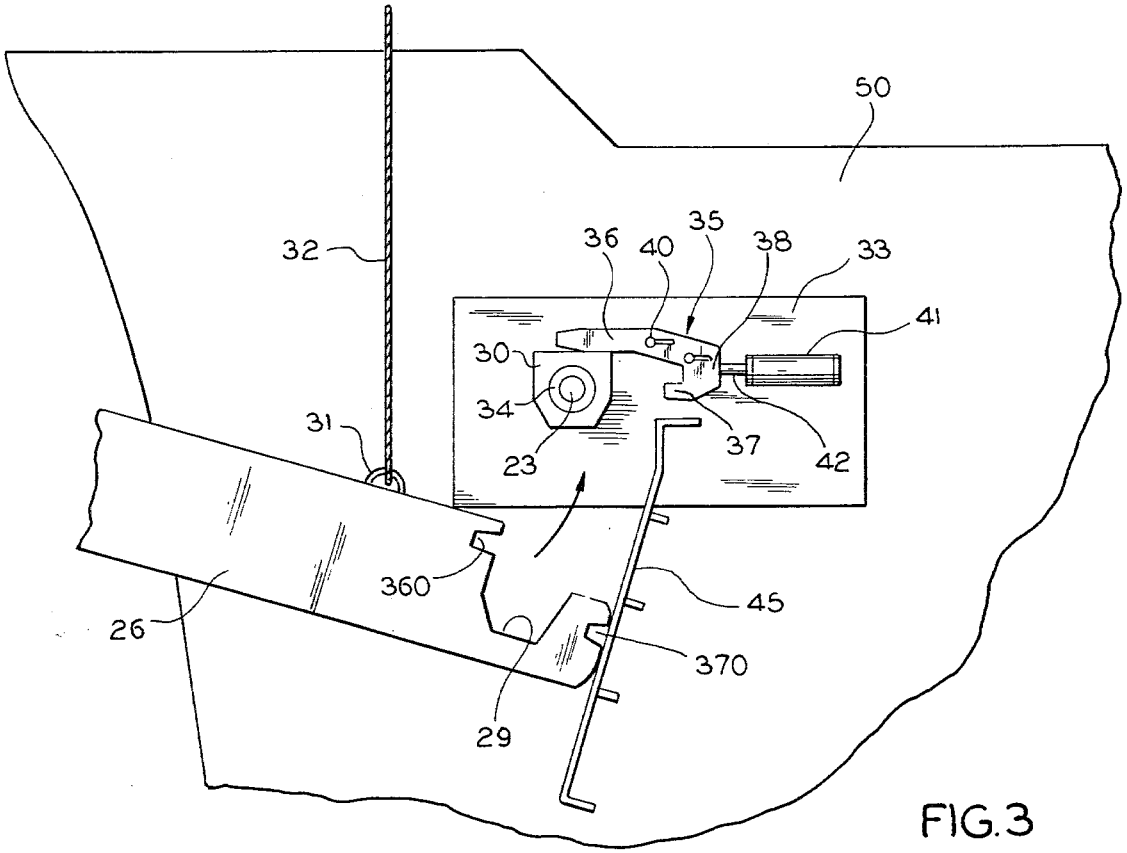
FIG. 3 is a side elevational view of a vessel bow showing the end of a vessel mooring yoke arm, a trunnion on a vessel and a locking means for securing the arm end to the trunnion.
Figure 4:
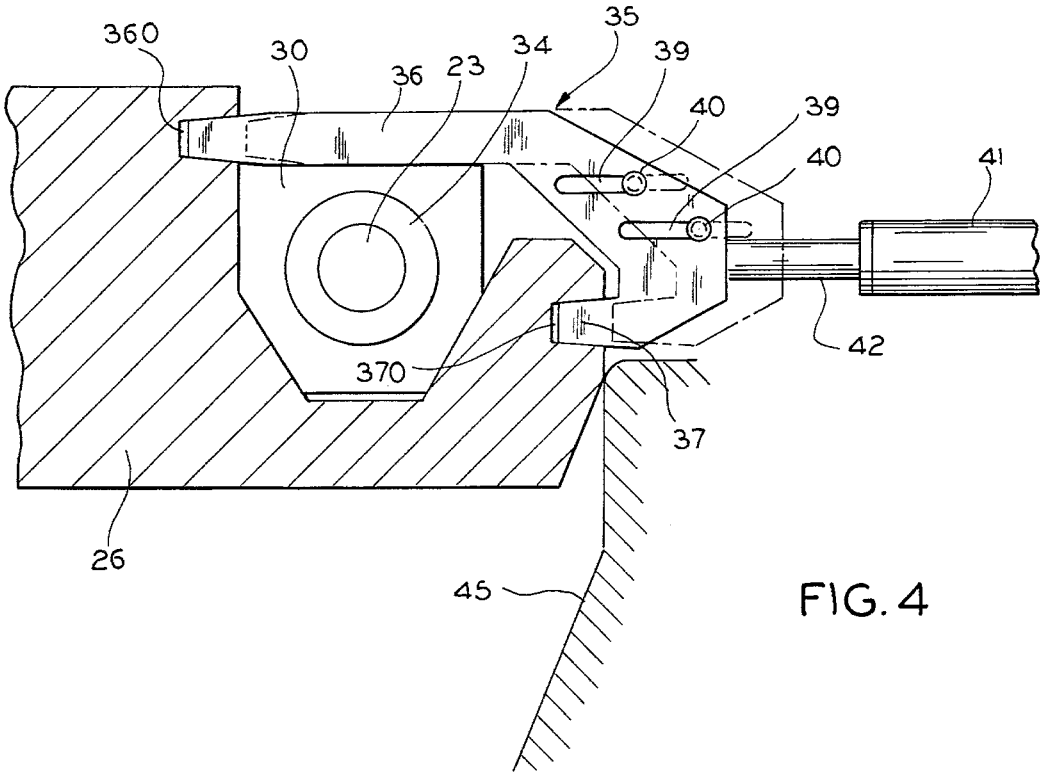
FIG. 4 is an enlarged view of the trunnion and locking means shown in FIG. 3.

Each trunnion 30 is rotatably mounted on bearings 34 on stationary shaft 23 (FIGS. 3 and 4). Plate 33 is positioned between trunnion 30 and the adjacent side of the vessel bow. The plate 33 is joined to the trunnion so as to rotate with it.

Mounted on each of the two plates 33 is a locking means 35 for holding the trunnions 30 in the respective pockets 28 and 29 after they have been placed in mating arrangement. The locking means 35 has a pair of fingers 36 and 37 which extend outwardly from a base 38. A pair of parallel slots 39 are provided in the locking means 35 so that it can move back and forth on pins 40 which are supported by and project outwardly from plate 33. Since the locking means 35 must be made large and heavy a hydraulic cylinder-piston unit 41 with rod 42 actuated thereby is used to move the locking means 35 back and forth. The ends of the fingers 36 and 37 are sized and arranged to enter the slots 360 and 370 in the end of the arms 26 and 27 to complete locking of the trunnions to the arms.

An alignment guide 45 is optionally provided on each side of the vessel bow, below and slightly to the rear of the trunnions, against which the ends of arms 26 and 27 make contact to stop forward movement of the vessel and to align the arm ends for upward movement into contact with the trunnions 30.

To moor a vessel using the apparatus illustrated in FIGS. 1 to 4, two lines 32 are dropped from the vessel and releasably attached to the handles 31. The yoke 25 is then raised sufficiently high so that the ends of the arms will contact alignment guide 45 upon forward movement of the vessel. Thrusters, tugs or the line pull are then used to move the vessel forward to put the ends of the arms in contact with guides 45 and to hold them there while the arms are raised to mate each trunnion 30 in a pocket 29. The hydraulic unit 41 is then activated and the locking means 35 moved forward so that the ends of fingers 36 and 37 engage in slots 360 and 370, which are provided with sloped top and bottom surfaces to aid entry of the finger ends and the subsequent development of a tight attachment. The lines 32 are then disconnected to complete mooring of the ship.

The described mooring apparatus maintains the vessel a predetermined moored distance from the stationary means or tower 17. This makes it possible for ancillary equipment to be properly positioned. The vessel can, of course, rotate 360° around the tower 17, even though it is moored, because of swivel 16. In this regard, if a ball and socket connection is used for the universal joint 18 as shown in FIG. 2, the entire tower may rotate and swivel 16 might be dispensed with. It is advisable, however, when a ball and socket connection is used, to employ one which does not permit vertical axial rotation due to a built-in restraint.

An advantage of the mooring apparatus provided by this invention is that it permits a vessel to be quickly disconnected. Thus, by activating hydraulic unit 41 to retract rod 42 the locking means 35 is retracted to pull the ends of fingers 36 and 37 out of slots 360 and 370. The cantilevered weight of mooring member 10 causes it to drop to the sea where it floats, thereby freeing the vessel.

Figure 5:
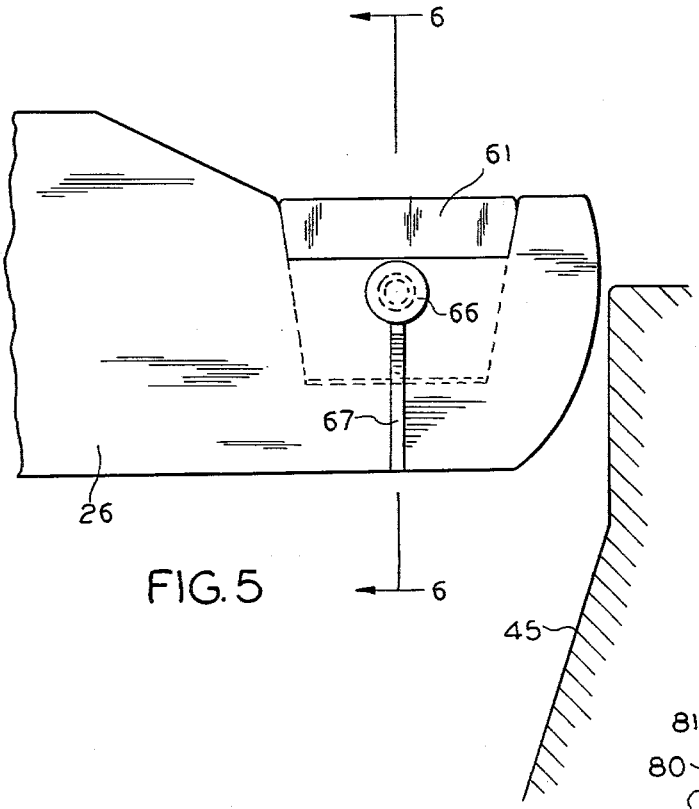
FIG. 5 is a side elevational view of a second embodiment of trunnion and locking means for securing a mooring arm thereto.
Figure 6:
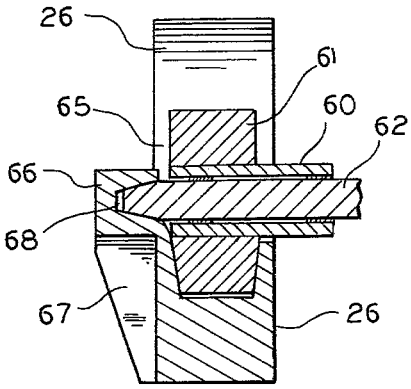
FIG. 6 is a sectional view taken along the line 6—6 of FIG. 5.

FIGS. 5 and 6 illustrate a second embodiment of a quick disconnect apparatus. In this embodiment, hollow tube 60 is connected to the bow of a vessel and trunnion 61 is rotatably mounted thereon. Rod 62 is slidably positioned inside of tube 60. Arm 26 is provided with a pocket or recess 65 in which trunnion 61 fits in mating arrangement. A lateral cylindrical extension 66 is located on the arm 26 and it is supported by flange 67. Conical hole 68 in extension 66 is positioned to receive the end of rod 62 to thereby lock the trunnion 61 and the end of arm 26 together. It should be understood that a similar mechanism is located on the other side of a vessel bow.

Figure 7:
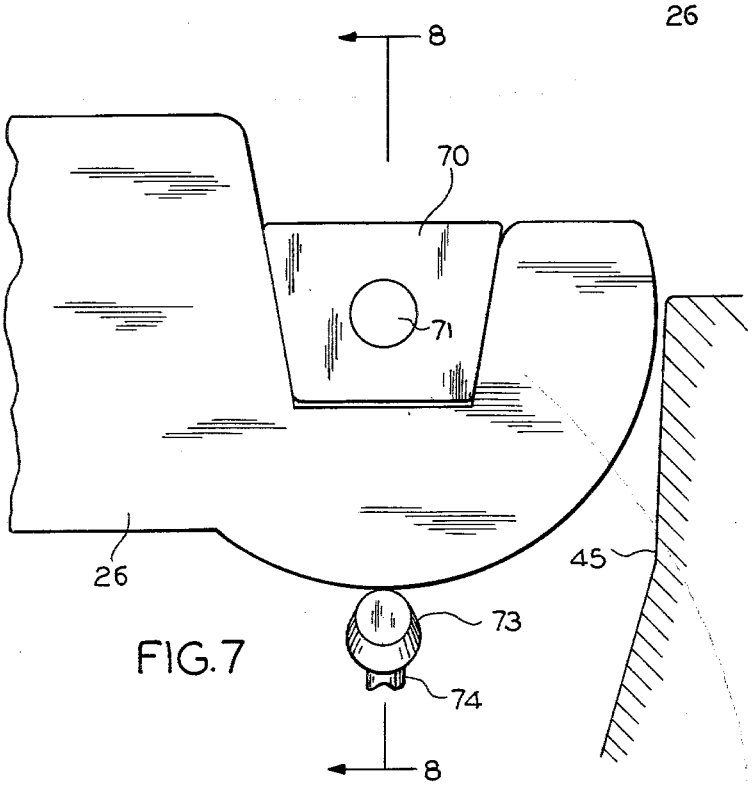
FIG. 7 is a side elevational view of a third embodiment of trunnion and locking means for securing a mooring arm thereto.
Figure 8:
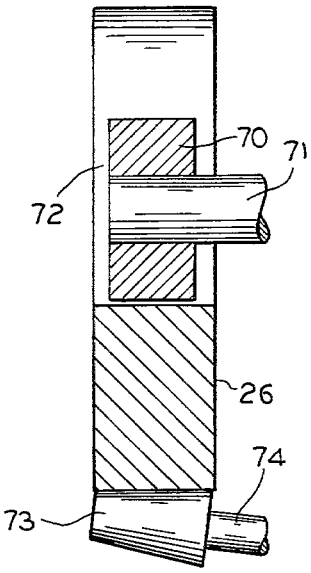
FIG. 8 is a sectional view taken along the line 8—8 of FIG. 7.

A third embodiment of the invention is shown in FIGS. 7 and 8. In this embodiment, trunnion 70 is rotatably mounted on axle 71 which extends to a vessel bow. The trunnion 70 fits into recess 72 in the end of arm 26. Conical roller 73 on axle 74 supports the arm 26 from dropping down after the trunnion 70 and recess 72 are placed in mating arrangement. The axle 74 is mounted on a crank arm, not shown, so that it can be swung into supporting position beneath arm 26 to lock the arm in place, and subsequently can be quickly swung away from that position so the arm 26 can drop by gravity and thereby release the vessel.

As is shown in the three embodiments of the invention illustrated by the drawings, the trunnions and the mating recesses or pockets in the arm ends have sloped sides to facilitate mating the elements together and the creation of a tight connection with little, if any, free play. It would be obvious, however, to use other mating shapes for the trunnions and the pockets. Thus, the trunnions could be semi-cylindrical, triangular rods or semi-spherical.

Figure 9:
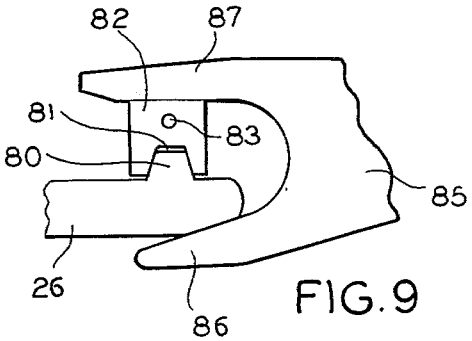
FIG. 9 is a side elevational view of a fourth embodiment of the invention and shows a trunnion mooring yoke arm and locking mechanism.

FIG. 9 illustrates a fourth embodiment of the invention which differs from the first three embodiments in that the locking mechanism, which also employs a male-female connection, has the male element 80 on arm 26 and the female element or pocket 81 on the bottom of trunnion 82 on axle 83. After the arm 26 has been brought into position to moor a vessel, the locking mechanism 85 is moved forward to place finger 86 below the end of arm 26 and finger 87 over the top of trunnion 82. A quick disconnect is achieved by simply moving the locking mechanism in the opposite direction so that the arm 26 is freed and can drop of its own weight into the sea.

What is claimed is:

1. A quick-release mooring apparatus for a floating vessel comprising:

a substantially stationary means anchored to the sea floor and projecting above sea level, a vessel mooring member attached at a first end above sea level to the stationary means in a manner which permits the mooring member to rotate about vertical and horizontal axes passing through the point of attachment to the stationary means, the second end of the mooring member comprising a vessel mooring yoke having a pair of spaced arms, one end of each of which is adapted to be releasably attached, by lifting the vessel mooring yoke, to opposite sides of the bow of a vessel for rotation about a horizontal axis, each arm containing a pocket open at the top in which a trunnion mounted on the vessel can mate when the vessel mooring yoke is lifted into releasable engageable contact therewith, and the mooring member having sufficient buoyancy for the second end to float on the sea when unconnected to a vessel.

2. In combination:

a substantially stationary means anchored to the sea floor and projecting above sea level, a vessel, a vessel mooring member attached at a first end above sea level to the stationary means in a manner which permits the mooring member to rotate about vertical and horizontal axes passing through the point of attachment to the stationary means, the second end of the mooring member comprising a vessel mooring yoke having a pair of spaced arms, one end of each of which is releasably attached, by lifting the vessel mooring yoke, to opposite sides of the bow of a vessel for rotation about a horizontal axis and for quick release from such attachment so that the second end can drop by gravity to the sea, each arm containing a pocket open at the top mated with a trunnion mounted on the vessel bow, and the mooring member having sufficient buoyancy for the second end to float on the sea when unconnected to a vessel.

3. A combination according to claim 2 in which a locking means releasably secures each trunnion to each arm of the ship mooring yoke.

4. A combination according to claim 3 in which the locking means has at least one finger or pin extending from each trunnion to the adjacent vessel mooring yoke arm.

5. A combination according to claim 3 in which the locking means includes a pair of upper and lower parallel fingers joined together at one end so the upper finger is positioned above and in contact with the trunnion, and so the ends of the fingers nest in holes in the vessel yoke arm.

6. A combination according to claim 2 in which the trunnion is rotatable about a horizontal axis, and the pocket and trunnion contain complementary planar surfaces.

7. A combination according to claim 2 in which the vessel yoke arms are supported, with the trunnions nesting in the pockets, by a retaining means removably positioned to restrain downward displacement of the arms from the trunnions and unmooring of the vessel, and which retaining means upon being removed frees the arms and permits the vessel mooring yoke end to drop by gravity to the sea surface.

8. In combination:

a substantially stationary means anchored to the sea floor and projecting above sea level, a vessel, a vessel mooring member attached at a first end above sea level to the stationary means in a manner which permits the mooring member to rotate about vertical and horizontal axes passing through the point of attachment to the stationary means, the second end of the mooring member comprising a vessel mooring yoke having a pair of spaced arms, one end of each of which is releasably attached, by lifting the vessel mooring yoke, to opposite sides of the bow of a vessel for rotation about a horizontal axis and for quick release from such attachment so that the second end can drop by gravity to the sea, each arm containing a male element at the top mated with a pocket in a trunnion mounted on the vessel bow, and the mooring member having sufficient buoyancy for the second end to float on the sea when unconnected to a vessel.

9. A combination according to claim 8 in which the trunnion is rotatable about a horizontal axis, and the pocket and trunnion contain complementary planar surfaces.

10. A combination according to claim 8 in which locking means releasably secures each trunnion to each arm of the ship mooring yoke.

11. A combination according to claim 10 in which the locking means has at least one finger or pin extending from each trunnion to the adjacent vessel mooring yoke arm.

12. A combination according to claim 10 in which the locking means includes a pair of upper and lower parallel fingers joined together at one end so the upper finger is positioned above and in contact with the trunnion, and so the ends of the fingers nest in holes in the vessel yoke arm.

13. A combination according to claim 8 in which the vessel yoke arms are supportable, with the trunnions nesting in the pockets, by a retaining means removably positioned to restrain downward displacement of the arms from the trunnions and unmooring of the vessel, and which retaining means upon being removed frees the arms and permits the vessel mooring yoke end to drop by gravity to the sea surface.

14. In combination:

a substantially stationary means anchored to the sea floor and projecting above sea level, a vessel, a vessel mooring member attached at a first end above sea level to the stationary means in a manner which permits the mooring member to rotate about vertical and horizontal axes passing through the point of attachment to the stationary means, the second end of the mooring member comprising a vessel mooring yoke having a pair of spaced arms, one end of each of which is releasably attached, by lifting the vessel mooring yoke, to opposite sides of the bow of a vessel for rotation about a horizontal axis and for quick release from such attachment so that the second end can drop by gravity to the sea, the arm ends being attached to the ship bow by a quick release locking means, and the mooring member having sufficient buoyancy for the second end to float on the sea when unconnected to a vessel.

15. A mooring apparatus according to claim 14 in which the stationary means is a tower supported by the sea floor.

16. A mooring apparatus accordng to claim 15 in which the tower has a universal joint near the bottom and the upper part of the tower has buoyancy means.

17. A quick-release mooring apparatus for a floating vessel comprising:

a substantially stationary means anchored to the sea floor and projecting above sea level, a vessel mooring member attached at a first end above sea level to the stationary means in a manner which permits the mooring member to rotate about vertical and horizontal axes passing through the point of attachment to the stationary means, the second end of the mooring member comprising a vessel mooring yoke having a pair of spaced arms, one end of each of which is adapted to be releasably attached, by lifting the vessel mooring yoke, to opposite sides of the bow of a vessel for rotation about a horizontal axis, each arm containing a male element at the top in which a pocket in a trunnion mounted on the vessel can mate when the vessel mooring yoke is lifted into releasable engagable contact therewith, and the mooring member having sufficient buoyancy for the second end to float on the sea when unconnected to a vessel.

18. A quick release mooring apparatus for a floating vessel comprising:

a substantially stationary means anchored to the sea floor and projecting above sea level, a vessel mooring member attached at a first end above sea level to the stationary means in a manner which permits the mooring member to rotate about vertical and horizontal axes passing through the point of attachment to the stationary means, the second end of the mooring member comprising a vessel mooring yoke having a pair of spaced arms, one end of each of which is releasably attachable, by lifting the vessel mooring yoke, to opposite sides of the bow of a vessel for rotation about a horizontal axis and for quick release from such attachment so that the second end can drop by gravity to the sea, the arm ends being attachable to the ship bow by a quick release locking means, and the mooring member having sufficient buoyancy for the second end to float on the sea when unconnected to a vessel.

19. A mooring apparatus according to claim 18 in which the stationary means is a tower supported by the sea floor.

20. A mooring apparatus according to claim 19 in which the tower has a universal joint near the bottom and the upper part of the tower has buoyancy means.

* * * * *